US005105960A

United States Patent [19]

Crisci et al.

[11] Patent Number: 5,105,960

[45] Date of Patent: Apr. 21, 1992

[54] CONTAINER AND CLOSURE WITH COOPERATING THREADED PORTIONS HAVING FASTENING CONFIGURATIONS

[75] Inventors: Robert Crisci, New Castle, Pa.; Joseph Bashour, Glendale, Mass.

[73] Assignee: Northern Engineering & Plastics, Corp., New Castle, Pa.

[21] Appl. No.: 785,814

[22] Filed: Oct. 31, 1991

Related U.S. Application Data

[63] Continuation-in-part of Ser. No. 632,538, Dec. 24, 1990, abandoned.

[51] Int. Cl.[5] ..... B65D 41/04

[52] U.S. Cl. ..... 215/329; 215/330; 215/217; 215/252; 215/254

[58] Field of Search ..... 215/330, 329, 217, 31, 215/252, 254, 256

[56] References Cited

U.S. PATENT DOCUMENTS

| | | | |
|---|---|---|---|
| 1,741,108 | 12/1929 | Gruver | 215/330 |
| 2,162,880 | 6/1939 | Brown | 215/330 |
| 3,297,185 | 1/1967 | Plymale | 215/330 |
| 3,504,818 | 4/1970 | Crisci et al. . | |
| 3,682,345 | 8/1972 | Baugh | 215/330 |
| 3,902,621 | 9/1975 | Hidding . | |
| 3,963,139 | 6/1976 | Gach | 215/217 X |
| 3,980,195 | 9/1976 | Fillmore | 215/330 X |
| 4,034,882 | 7/1977 | Wright | 215/217 |
| 4,053,077 | 10/1977 | DeFelice | 215/217 |
| 4,084,716 | 4/1978 | Bogert | 215/217 |
| 4,498,597 | 2/1985 | Bashour . | |

*Primary Examiner*—Stephen Marcus
*Assistant Examiner*—Paul A. Schwarz
*Attorney, Agent, or Firm*—Harpman & Harpman

[57] ABSTRACT

A container for use in combination with a closure has a threaded neck and a flexible lip portion which extends inwardly and upwardly from the top of the neck portion and which defines the opening to the container. The closure has a top portion from which depends a threaded annular skirt which cooperates with the threaded neck portion. The upper surface of the threads on the annular skirt have a plurality of radially extending small upwardly pointed ribs defining fastening configurations registrable with a plurality of radially extending small downwardly pointed ribs on the lower surfaces of the thread on the neck portion of the container. The threads of the closure are smaller than the threads on the neck of the container so as to extend a lesser distance toward the neck of the container than the distance the thread on the neck of the container extends toward the closure. A flexible annular ring is attached to the closure by a plurality of radially extending frangible elements has a plurality of circumferentially spaced radially inwardly extending angular projections arranged for registry with a ratchet section on the neck portion of the container when the closure and ring are rotated in one direction and so formed as to prevent rotation of said annular ring in the opposite direction without removal to indicate tampering with the closure.

4 Claims, 2 Drawing Sheets

CONTAINER AND CLOSURE WITH COOPERATING THREADED PORTIONS HAVING FASTENING CONFIGURATIONS

This is a CIP application of Ser. No. 07/632,538 of Robert E. Crisci, et al, filed Dec. 24, 1990, now abandoned.

BACKGROUND OF THE INVENTION

1. Technical Field

This invention relates to containers and closures therefore designed to indicate the removal of the closure so that the purchaser may be assured that the contents of the container are as originally packed.

2. Description of Prior Art

Prior art containers and closures, for example, milk bottles require a closure which tightly seals the opening of the container to prevent leakage of the contents therein. A typical container has a threaded neck with a horizontal radially inturned directed annular flange at the top of the neck which defines the opening to the container. A typical threaded closure for use therewith is shown in U.S. Pat. No. 3,504,818 in which a closure formed of resilient flexible plastic material is disclosed for use on a blow molded flexible plastic bottle.

Another prior art disclosure comprises U.S. Pat. No. 3,902,621 which is similar to the closure of U.S. Pat. No. 3,504,818 with the exception that the annular tamper indicator ring is separated and an elongated pull tab extends outwardly so as to connect the ends of the tamper indicating ring.

A still further prior art disclosure comprises U.S. Pat. No. 4,498,597 wherein the container has a threaded neck portion and a flexible lip portion which extends inwardly and upwardly from the top of the neck portion.

Each of these prior art references and many similar closures incorporating threaded neck portions and threaded closures for registry therewith have the common fault of a so-called initial loosening of the closure once it has been threaded onto the container neck as the prior art threaded closures engageable on threaded necks of containers relied on increased friction between the engaging threads of the closure and the threads of the neck portion to hold the closure in sealed position on the neck portion of the container. Such containers and closures are generally made of resilient flexible plastic material and distortion or changes in the tension on the closure and neck portion frequently causes a loosening of the closure as the closure backs off slightly from its turned on initial position on the neck portion and this slight movement frequently results in leakage of the contents of the container. None of the prior art devices have been able to control such initial changes in the position of the closure relative to the threaded neck portion and the actual cause of such reverse rotation of the closure is unknown.

The present invention provides a simple efficient and novel means of substantially increasing and controlling the frictional engagement of the threads in the closure with the threads on the threaded neck portion of the container by forming the threads on the neck portion of the container with a surface area larger than the surface area of the threads in the closure and forming a plurality of radially upwardly extending small ribs on the upper smaller surface area of the threads on the interior of the closure and a similar series of radially downwardly extending small ribs on the larger lower surface area of the threads on the threaded neck of the container. The small ribs are on the smaller engaging surfaces of the threads of the closure and the larger threads on the threaded neck portion in effect form very desirable special limited roughened surfaces which substantially hold the closure in its initial turned on position relative to the neck portion of the container and prevents counter rotation as above described which leads to looseness of the closure and leakage of the contents of the container and at the same time ensures against too much thread to thread locking action.

SUMMARY OF THE INVENTION

Milk bottles and other containers of the one gallon or half gallon size are usually blow molded of resilient flexible plastic material and employ resilient flexible plastic closures threadable engaged thereon and have become widely used in distributing milk and other liquids due to their inexpensiveness and tamper indicating means such as follows:

The present invention forms a plurality of rachet sections on two areas of the neck of the container and utilizes a threaded closure of integrally molded resilient plastic construction having an annular ring so-formed as to be readily broken away from the remainder of the closure. The annular ring includes a plurality of rachet configurations on its inner surface which are registerable with the rachet formations on the neck when the closure is removed.

In addition, the present construction provides a split in the annular ring on the closure and a tear tab extending from one of the ends of the annular rings so that the closure may be optionally removed by pulling the tear tab and freeing the annular ring from the closure. The closure of the present invention also has a straightened relatively rigid depending sealing flange for engaging a flexible inturned flange on the neck of the container which defines the opening therein and the threads of the closure are provided with a uniquely roughened upper surface by formation of a series of very small radially upwardly extending ribs which frictionally engage portions of a similar series of radially downwardly extending very small ribs formed on the bottom of the threads on the threaded neck portion of the container. The upper surfaces of the threads on the closure engage a portion of the lower surfaces of the threads on the threaded neck of the container and the roughened surfaces thereof formed by the radially extending very small ribs serve to hold the closure on the threaded neck of the container in a desired position preventing loosening of the closure and resulting leakage from the container. The threads of the closure being smaller than the threads on the neck of the container so as to extend a lesser distance towards the neck of the container than the distance the threads on the neck of the container extend towards the closure.

DESCRIPTION OF THE PREFERRED EMBODIMENT

Figure 1:
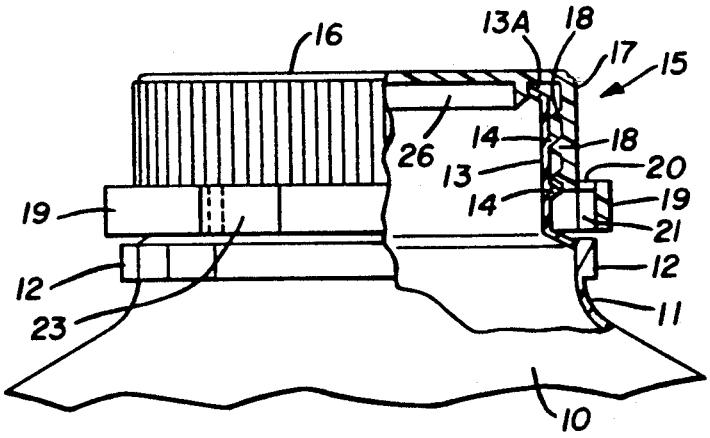
FIG. 1 is a side elevation with parts broken away of a neck portion of a container and a closure partially positioned thereon.

By referring to the drawings and FIG. 1 in particular, it will be seen that a container 10 is partially illustrated and has a neck portion 11 which is provided with two rachet sections 12. The neck portion 11 extends inwardly and upwardly above the two rachet sections 12 as indicated at 13 and has a spiral thread 14 formed thereon with flat upper and lower surfaces so that a threaded closure 15 may be threadably engaged thereon. The spiral thread 14 extends outwardly of the neck portion a known distance. Still referring to FIG. 1 of the drawings, it will be seen that the threaded closure 15 has a top portion 15 and a depending annular flange 17 on the periphery thereof, the annual flange 17 having a spiral thread 18 with flattened angular surfaces on the inner surfaces thereof which extends inwardly towards the neck portion 11 of the container 10 to a lesser distance than the known outwardly extending distance of the spiral thread 14 on the neck portion 11 so as to space the closure 15 with respect to the neck portion 11 of the container 10 and permit adjustment of the interengagement of said spiral threads.

A break-away annular ring 19 is integrally molded with the closure 15 by interconnecting frangible elements 20. The annular ring 19 is of a larger diameter than the depending annular flange 17 of the closure and the annular ring 19 has a plurality of circumferentially spaced inwardly facing angular projections 21. The inwardly facing angular projections 21 are arranged for interlocking registry with the rachet sections 12 when the closure is rotated clock-wise and moves downwardly to position the annular ring 19 and the rachet sections 12 in side by side position. The annular ring 19 is flexible and when the inwardly facing angular portions 21 thereon move in positions adjacent the rachet sections 12, rotation of the closure 15 with the annular ring will cause the annular ring 19 to move outwardly and slide over the rachet sections 12 due to their configurations and the circumferentially spaced inwardly facing angular projections 21.

Figure 2:
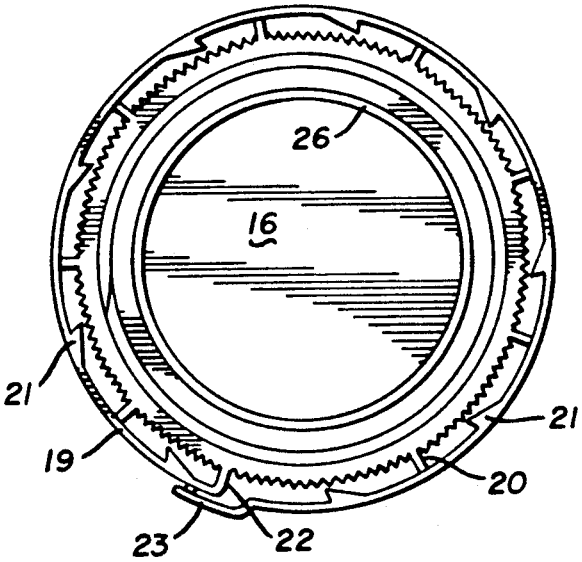
FIG. 2 is a bottom plan view of the closure of FIG. 1.

By referring now to FIGS. 1 and 2 of the drawings, it will be seen that the break-away annular ring 19 has an inturned end 22 on one side of a split therein and a tear tab 23 is formed on the opposite end and is offset slightly so as to overlie the inturned end 22 of the annular ring 19.

It will be seen that removing the closure 15 from the neck portion 11 of the container 10 requires counter clockwise rotation of the closure 15 and that such counter clockwise rotation is blocked by the engagement of the inwardly facing angular projections 21 on the annular ring 19 and rachet-like engagement thereof with the rachet sections 12 on the neck portion 11 of the container so that when sufficient twisting torque is applied in a counter clockwise direction to the closure, the frangible elements 20 will break, separating the annular ring 19 from the remainder of the closure 15 whereupon it may be removed in a counter clockwise direction to move upwardly and away from the neck portion 11 of the container 10.

It will be seen that an alternate means of permitting the closure 15 to be revolved upwardly and away from the neck portion of the container is that the annular ring 19 with its inwardly facing annular projections 21 may be removed completely from the closure 15 by grasping the tear tab 23 and pulling it outwardly and away from the depending annular flange 17 of the closure 15 whereupon there will be no mechanical engagement between the inwardly facing angular projections 21 and the rachet sections 12.

Figure 4:
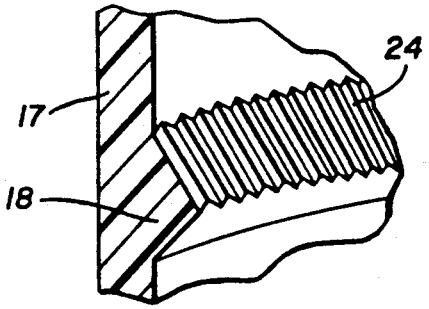
FIG. 4 is a generally enlarged perspective view of a section of the closure and the threaded pattern thereon on lines 4—4 of FIG. 3.
Figure 3:
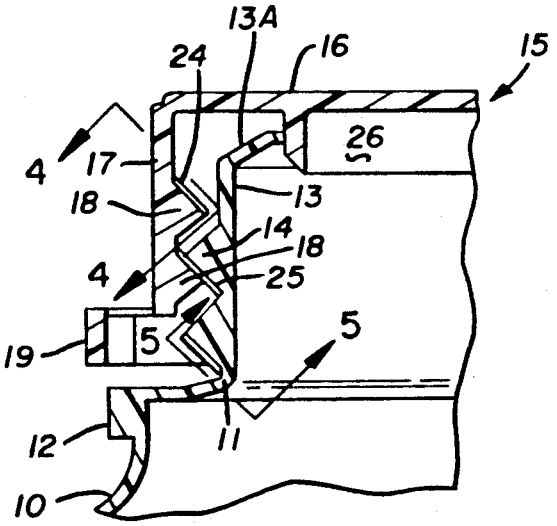
FIG. 3 is an enlarged cross-sectional elevation of a portion of the neck portion of the container and the closure of FIG. 1.

By referring now to FIG. 3 of the drawings, an enlarged section of a portion of the closure 15 and the neck portion 11 of the container 10 may be seen and illustrates the upper flat surface of the spiral thread 18 on the inner surface of the depending annular flange 17 of the closure being provided with a series of extremely small radially upwardly extending ribs 24 which are illustrated in still greater enlarged detail in FIG. 4 of the drawings.

Figure 5:
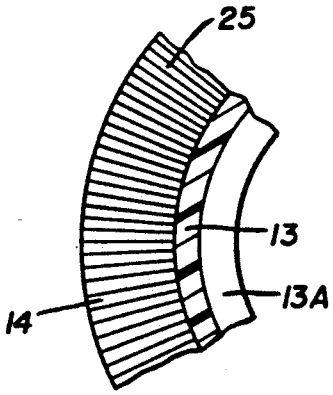
FIG. 5 is a generally enlarged bottom view of a portion of the container neck and the thread thereon on lines 5—5 of FIG. 3.
Figure 7:
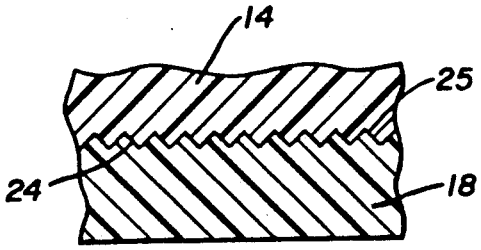
FIG. 7 is a very greatly enlarged cross-sectional elevation of the threads on the closure and the container neck portion in engaging holding position.

Referring again to FIG. 3 of the drawings, it will be seen that the lower flat surfaces of the spiral thread 14 on the exterior of the neck portion 11 of the container 10 has a series of extremely small radially downwardly extending ribs 25 on the lower surface thereof which are illustrated in FIG. 5 of the drawings.

In FIG. 3 of the drawings, the portion of the closure 15 and the neck portion 11 of the container 10 with their inner engaging spiral thread patterns 18 and 14 respectively are shown moved into partial engagement responsive to clockwise rotation of the closure 15 with respect to the neck portion 11 of the container and that engagement between the thread patterns is illustrated between all of the upper flat surfaces of the spiral thread 18 on the closure 15 with part of the lower flat surface of the spiral thread 14 on the neck portion 11 with an interengagement of the ribs 24 on the spiral thread 18 beginning to engage the ribs 25 on the lower surface of the spiral thread 14 on the neck portion 11.

Figure 6:
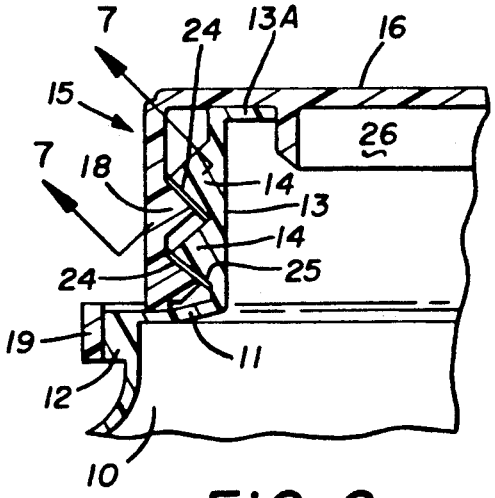
FIG. 6 is an enlarged cross-sectional elevation of a portion of the neck portion of the container and the closure similar to FIG. 3 and showing the closure in sealed position on the neck portion of the container.

The ribs 24 and 25 are so small that they function as a roughened surface and permit normal clockwise rotation of the closure 15 downwardly upon the neck portion 11 of the container from the position shown in FIG. 3 of the drawings to the position shown in FIG. 6 of the drawings where the closure 15 has moved downwardly bringing the top portion 16 thereof into engagement with the flexible flange 13A that forms the principal seal of the closure by its engagement with the top 16 of the closure and a depending annular sealing flange 26.

The frictional engagement of the upper and lower surfaces of the spiral threads 18 and 14, respectively, which carry the small ribs 24 and 25 respectively, increase their frictional resistance to rotation of the closure 15 as the closure seats firmly on the neck portion 11 of the container 10 and upon termination of the rotation action, the ribs 24 and 25 on the engaging portion of the spiral threads 18 and 14 form a substantially increased frictional engagement between the spiral threads 18 and 14 and in effect hold the closure 15 in its desired closed position which successfully avoids the heretofore problem of the back-off of the closures with respect to the threaded engagement on the containers on which the closure depends. The limited engagement of the roughened areas on the threads 14 and 18 is controllable by reason of the space between the closure 15 and the neck portion 11 which permits deflection of the closure 15 and the spiral threads 18 as the flange 13A of the neck portion engages the sealing flange 26 and the top 16 of the closure 15.

The present invention accordingly solves a substantial problem that has existed as long as threaded flexible plastic closures have been positioned on threaded flexible plastic neck portions of containers, such as blow molded containers and the like usually formed of polyethylene synthetic resin.

The invention permits continued and expanded use of the internally threaded plastic closures on blow molded plastic milk bottles and the like by existing, bottling and capping equipment which automatically rapidly applied threaded closures to threaded neck portions of containers as known in the art.

Although, but one embodiment of the present invention has been illustrated and described, it will be apparent to those skilled in the art that various changes and modification may be made therein without departing from the spirit of the invention or from the scope of the applied claims and having thus described our invention.

What we claim is:

1. In the combination of a container and in a closure therefore wherein the container has a neck defining an access opening, the neck having rachet sections and a spiral thread having upper and lower flat right angular surfaces extending outwardly of said neck, the closure having a top portion, an annular depending flange on said top portion, a spiral thread having upper and lower flat right angular surfaces in said annular depending flange engageable with said spiral thread on said neck, a plurality of circumferentially spaced radially outwardly extending frangible elements on said depending annular flange, a thin flexible annular ring carried on the outer ends of said frangible elements in spaced relation to said depending annular flange, a plurality of circumferentially spaced radially inwardly extending angular projections on said thin flexible annular ring arranged for registry with said rachet sections on said neck; the improvement comprising forming said spiral thread on said neck extending outwardly of said neck a known distance and forming said spiral thread in said annular depending flange extending inwardly of said annular depending flange a distance less than said known distance, oppositely disposed roughened surfaces on said flat right angular surfaces, of said spiral threads on said neck and on said spiral thread in said annular depending flange for forming increased frictional engagement between said spiral threads when said closure is engaged on said neck whereby said closure retains a fixed position on said neck of said container, said roughened surface on said spiral thread on said neck being greater than said roughened surface on said spiral thread in said annular depending flange so as to limit the increased frictional engagement between said spiral threads whereby said closure retains a fixed position on said neck of said container without locking thereon.

2. The combination of claim 1 wherein said roughened surfaces of said spiral threads is formed on said lower surface of said spiral thread on said neck and on the upper surface of said spiral thread in said depending flange of said closure.

3. The combination of claim 1 wherein said roughened surfaces of said spiral threads comprise a plurality of very small radially extending ribs.

4. The combination of a container and a resilient closure therefore wherein the container has an upstanding neck defining an access opening, the neck having a spiral thread on the exterior thereof and a closure having an annular depending flange, a spiral thread in said annular depending flange engageable with said spiral thread on said neck and tamper indicating means on said closure; the improvement comprising means for holding said closure in closed relation on said neck, said means consisting of forming said spiral thread on said neck continuously extending outwardly of said neck a known distance and forming said spiral thread in said annular depending flange extending inwardly of said annular depending flange a distance less than the known distance, said spiral thread on said neck extends outwardly of said neck so as to form a space between said neck and said depending flange, roughened engaging surfaces on said spiral threads on said neck and in said annular depending flange, said roughened surfaces arrange for registry with one another, said formation of said spiral threads on said neck and said annular depending flange acting to form a space between said neck and said annular depending flange so as to limit the registry of said roughened engaging surfaces on said spiral threads on one another.

* * * * *